US007346935B1

(12) United States Patent
Patterson

(10) Patent No.: US 7,346,935 B1
(45) Date of Patent: Mar. 25, 2008

(54) STRETCHABLE HIGH FRICTION SOCKS

(75) Inventor: Joe Patterson, San Pedro, CA (US)

(73) Assignee: ToeSox, Inc., Carlsbad, CA (US)

( * ) Notice: Subject to any disclaimer, the term of this patent is extended or adjusted under 35 U.S.C. 154(b) by 0 days.

(21) Appl. No.: 11/179,068

(22) Filed: Jul. 12, 2005

(51) Int. Cl.
*A43B 17/00* (2006.01)

(52) U.S. Cl. ..... 2/239

(58) Field of Classification Search ..... 2/239–242, 2/409, 22; 66/185, 183, 178 R
See application file for complete search history.

(56) References Cited

U.S. PATENT DOCUMENTS

| | | | | | |
|---|---|---|---|---|---|
| 1,308,483 | A | | 7/1919 | Craighead | |
| 1,314,356 | A | * | 8/1919 | Nordblad | 66/187 |
| 2,179,124 | A | * | 11/1939 | Jesnig | 36/8.1 |
| 3,128,763 | A | | 4/1964 | Langenfeld et al. | |
| 3,676,940 | A | * | 7/1972 | Shively | 36/8.1 |
| 4,146,935 | A | * | 4/1979 | Hinton | 2/161.3 |
| 4,322,894 | A | | 4/1982 | Dykes | |
| 4,651,354 | A | | 3/1987 | Petry | |
| 4,728,538 | A | * | 3/1988 | Kaspar et al. | 427/288 |
| 4,775,345 | A | * | 10/1988 | Gifford | 441/75 |
| 5,205,071 | A | | 4/1993 | Hergenroeder | |
| 5,737,776 | A | * | 4/1998 | Jennings | 2/409 |
| 5,774,898 | A | | 7/1998 | Malpee | |
| 6,016,575 | A | | 1/2000 | Prychak | |
| 6,138,281 | A | * | 10/2000 | Chiaruttini | 2/239 |
| 6,158,253 | A | * | 12/2000 | Svoboda et al. | 66/178 R |
| 6,367,087 | B1 | * | 4/2002 | Spillman et al. | 2/239 |
| 6,378,139 | B1 | * | 4/2002 | Mazzaglia | 2/242 |
| D480,554 | S | * | 10/2003 | Roddy et al. | D2/989 |
| 6,708,348 | B1 | | 3/2004 | Romay | |
| 6,766,536 | B1 | | 7/2004 | Aarons | |
| 7,012,525 | B1 | * | 3/2006 | Ghioto | 340/552 |
| 7,107,626 | B1 | | 9/2006 | Andrews | |
| 2002/0000003 | A1 | * | 1/2002 | Boersema | 2/239 |
| 2003/0074718 | A1 | * | 4/2003 | English | 2/239 |
| 2004/0221371 | A1 | * | 11/2004 | Kato | 2/239 |
| 2005/0091725 | A1 | | 5/2005 | Alley | |
| 2005/0091729 | A1 | | 5/2005 | Alley | |
| 2005/0144703 | A1 | * | 7/2005 | Hilbert | 2/239 |
| 2006/0026740 | A1 | * | 2/2006 | Vargas et al. | 2/239 |

* cited by examiner

*Primary Examiner*—Alissa Hoey
(74) *Attorney, Agent, or Firm*—Manuel F. de la Cerra

(57) ABSTRACT

A woven sock body having a multitude of high friction dots defining friction buttons arrayed around the bottom thereof.

8 Claims, 3 Drawing Sheets

STRETCHABLE HIGH FRICTION SOCKS

CROSS-REFERENCES TO RELATED APPLICATIONS

Text

FIELD OF THE INVENTION

The present invention relates generally to socks and particularly to low profile active wear socks that can be worn for various exercises and disciplines and particularly pilates, yoga, karate, gymnastics and other floor sports.

BACKGROUND OF THE INVENTION

Description of the Prior Art

Various slippers and footwear have been proposed for use in active routines involving quick precise movement on a floor surface. Early work led to the proposal of stockings formed with tubes for receipt of a wearer's toes so that the toes could be articulated in use. A stocking of this type is shown in U.S. Pat. No. 1,308,483 to Craighead.

Other efforts have led to the proposal of socks of various configurations to address issues of perspiration. One such dry sock system is shown in U.S. Pat. No. 6,016,575 to Prychak. This sock is constructed with an upper portion fabricated from an elastomeric material and a lower portion constructed from an absorbent material and including toe sections. Socks of this type are satisfactory for their intended purpose but suffer the shortcoming that participants involved in active floor sports wearing such socks would not typically enjoy feeling of firm and reliable gripping with the underlying floor.

Various footwear has been proposed to enhance the performance of, for instance, track and field participants. In this regard, it has been proposed to construct a form fitting foot and toe cover from a stretchable fabric and to apply a rubber like material by a spatula to the entire bottom of the covering or to specific selected areas to act as spikes as by a hot melt glue. A device of this type is shown in U.S. Pat. No. 4,651,354 to Petrey. Petrey purposes that the rubberized material be built up to form a spike shape for better grip of the track or playing field. While satisfactory for track or field sports, such coverings have the shortcoming that the rubberized pads or spikes do not typically provide for firm gripping with a floor surface and, for instance, pilates. Furthermore, full sole coverings or spike-like patches do not lend to use or comfortable low profile relatively thin woven sock material and would likely be subject to cracking as the material was flexed in use.

The need for anti-skid gloves and footwear in high disciplined yoga exercises has long been recognized. In this regard, it has been proposed to provide footwear constructed of leather and covered in certain areas by a rubber material. Device of this type are shown in U.S. Pat. No. 6,766,536 to Aarons. While providing some support against slippage, devices of this type suffer the shortcoming that the footwear does not provide for a high degree of flexing and identical toe tubes and fails to afford the tactility simulating the feel of bare foot exercises.

Other efforts to provide gloves and socks for yoga activity has led to a proposal that a sock be formed with a separate big toe tube, the remaining toes being housed together at the end of the sock and a low coefficient of friction material be added. A device of this type is shown in Publication No. 2005/0091729 published May 5, 2005 to Alley. Such socks suffer a number of shortcomings including the fact that for pilate applications it is important that the five toes of the foot be allowed to spread apart during the athletic maneuvers involved and that all five toes have a high coefficient grip with the underlying floor surface.

Other athletic socks have been proposed which include separate toe compartments and are designed particularly for athletic activity. Such a sock is shown in U.S. Pat. No. 6,708,348 to Romay. Socks of this type suffer the shortcoming that, in addition to being relatively expensive to manufacture, they have a relatively slippery sole surface which discourages use in direct contact with floor exercises.

SUMMARY OF THE INVENTION

The gripping sock of the present invention is characterized by a woven low profile sock configured with a sole area having small dots in the form of high friction buttons arrayed about the bottom thereof to, in practice, maintain frictional contact with the underlying support surface during the active maneuvers in a floor exercises.

There has been outlined rather broadly the more important features of the invention in order that the detailed description thereof that follows may be better understood and in order that the present contribution to the art may be better appreciated. There are, of course, additional features of the invention that will be described herein and which will form the subject matter of the claims appended hereto.

In this respect, before explaining my preferred of the invention in detail, it is to be understood is not limited in its application to the details of construction and to the arrangements of the components set forth in the following description or illustrated in the drawings. The invention is capable of other embodiments and of being practiced and carried in various ways. Also, it is to be understood that the phraseology and terminology employed herein are for the purposes of descriptions and should not be regarded as limiting.

As such, those skilled in the art will appreciate the conception, upon which this disclosure is based, may readily be utilized as a basis for the designing of other structures, methods and systems for carrying out the several purposes of the present invention. It is important, therefore, that the claims be regarded as including such equivalent constructions in so far as they do not depart from the spirit of the present invention.

The sock will be form fitting and actually present a feeling not unlike a second skin. The toes are separated in practice to enhance the balance, flexibility, performance and minimize perspiration. In those embodiments where the sock is constructed of cotton, a natural fiber that breathes that, it serves to reduce moisture and friction between the toes, provides precise control and can eliminate blistering during workouts.

Other features and advantages of the invention will become apparent from the following detailed description, taken in conjunction with the accompanying drawings which illustrate, by way of example, the features of the invention.

DETAILED DESCRIPTION OF THE INVENTION

Figure 1:
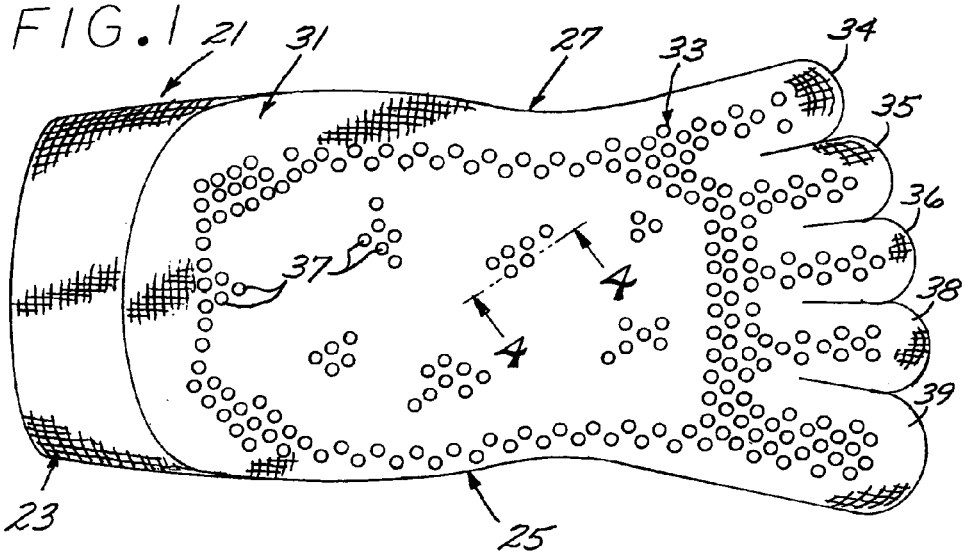
FIG. 1 is a bottom plan view of a gripping sock embodied in the present invention.
Figure 2:
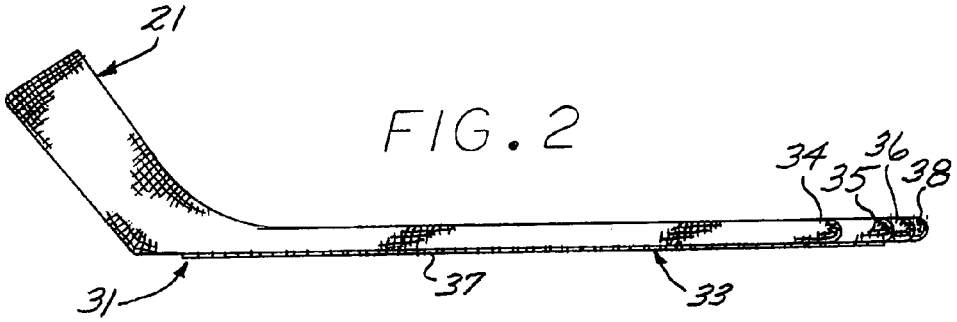
FIG. 2 is a left hand side view thereof.
Figure 3:
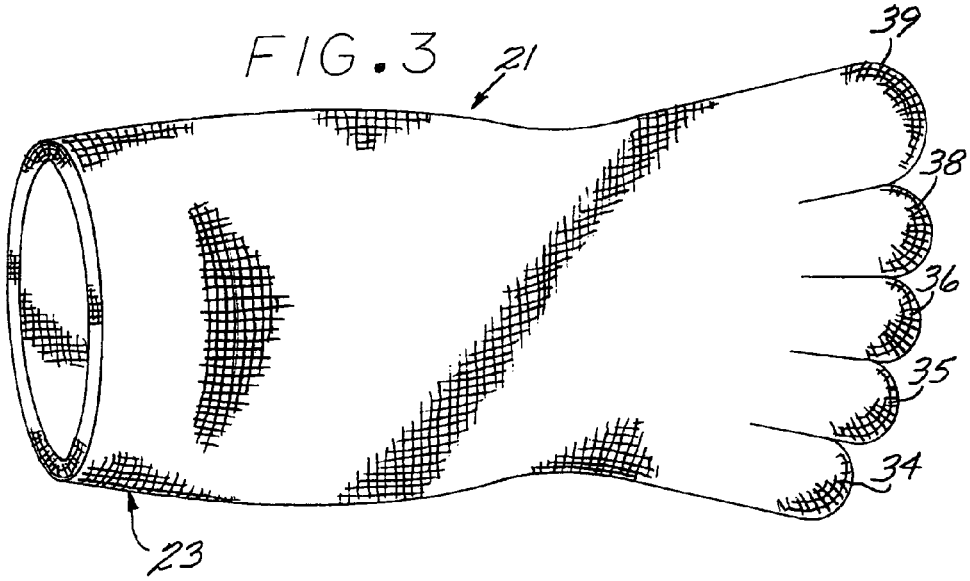
FIG. 3 is a top plan view thereof.
Figure 4:
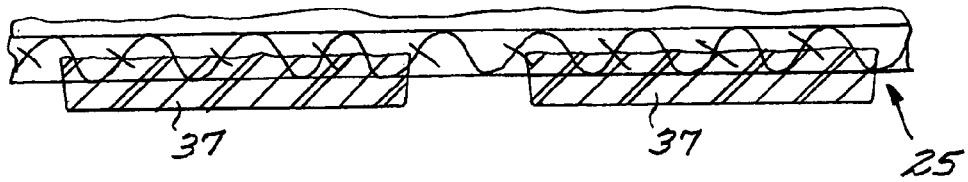
FIG. 4 is a partial vertical sectional view, in a large scale, taken along the line 4-4 of FIG. 1.
Figure 7:
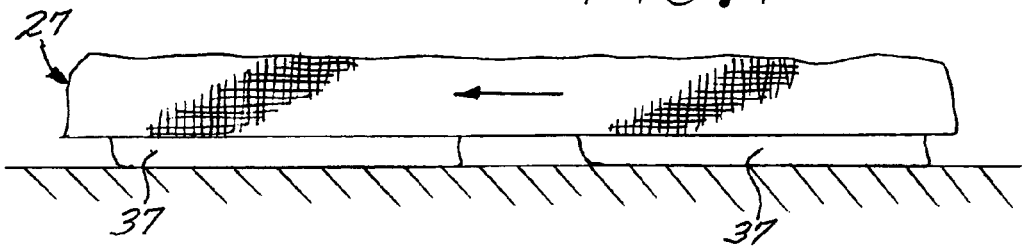
FIG. 7 is a detail view, in a large scale, taken from the circle 7 in FIG. 5.

Referring to FIGS. 1, 4 and 7, the gripping sock of the present invention includes, generally, a knit tube 21 in the shape of a sock, an ankle portion 23 foot portion 25 and sole 27. The sole includes heel and ball and sections 31 and 33 toe sections formed by the bottom walls of respective tubes 34, 35, 36, 37, 38 and 39 adhered to the underside of the sole portion is an array of high friction small diameter buttons 37 spaced throughout and located under at least the heel ball and toe portions of the sock.

Socks and particularly golf socks and the like are available in a relatively thin gauged material and are typically woven such that the sock material will stretch to fit over feet of various different sizes and shapes. In my invention, I prefer a relatively thin gauged weave, seamless weave, preferably about 30 gauge, to enhance the tactile characteristics thereof in use. The heddle may be about 130 (60×2) and the thread 30S single cotton. 30S single cotton is a specific example of a more general class of materials comprised of natural fibers. A sock is typically formed with a band around the ankle area and with a cup shape in the area of the heel section 31. In a typical sock for adult use, the sock, in its unstretched condition, may have a sole width of about 3½" inches and be about 6" inches long. I prefer to have a fairly dense concentration of high friction buttons 37 disposed about the entire sole area and particularly in the heel ball and toe section. I have found that by applying a generally uniform concentration of small diameter buttons about the sole area I can be assured that the working foot area of the athlete in contact with the underlying floor surface will always have several buttons in contact with the floor surface to maintain a high friction resistance to unwanted slippage. In my preferred embodiment, I array the buttons in a diagonal, spaced apart rows underneath the sole and arranged in checker board fashion so as to also form approximately 27 to 29 longitudinal columns spaced laterally apart and about 33 lateral rows spaced longitudinally apart. I array about 13 to 15 buttons in the section underneath the big toe and about 8 to 9 under the second toe, 7 to 9 under the third toe, about 7 on the fourth toe and about 5 under the little toe.

Figure 8:
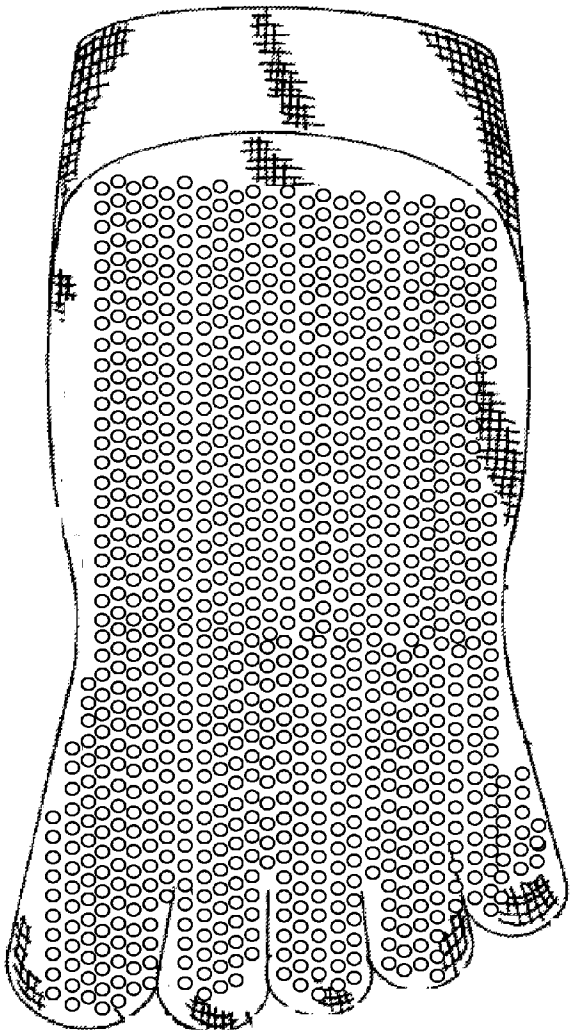
FIG. 8 is a bottom view of an embodiment of the gripping sock with at least 500 high friction buttons.

Underneath the ball, arch and heel I prefer at least 500 buttons (see FIG. 8), 900 preferably and for high energy activities about 950 buttons so that the small diameter buttons will add only minimum bulk to the body of the sock and present little resistance to foot articulation, while assuring that a plurality of buttons are always in contact with the underlying surface to thus maintain a firm grip to prevent accidental slippage.

In my preferred embodiment, I provide buttons which actually are more like dots and having a horizontal cross section of about ⅛" of an inch, a height of about 1/16" of an inch and a pattern spacing buttons uniformly apart ⅜" of an inch center to center. The button are preferably manufactured of rubberized material having substantial flexibility and are either flat on the bottom or formed with upwardly concave dimples to act as mini-suction cups when pressed against smooth polished floor. The sock body may be woven in a conventional manner and the button adhered thereto by a high temperature and moisture resistant adhesive.

Figure 5:
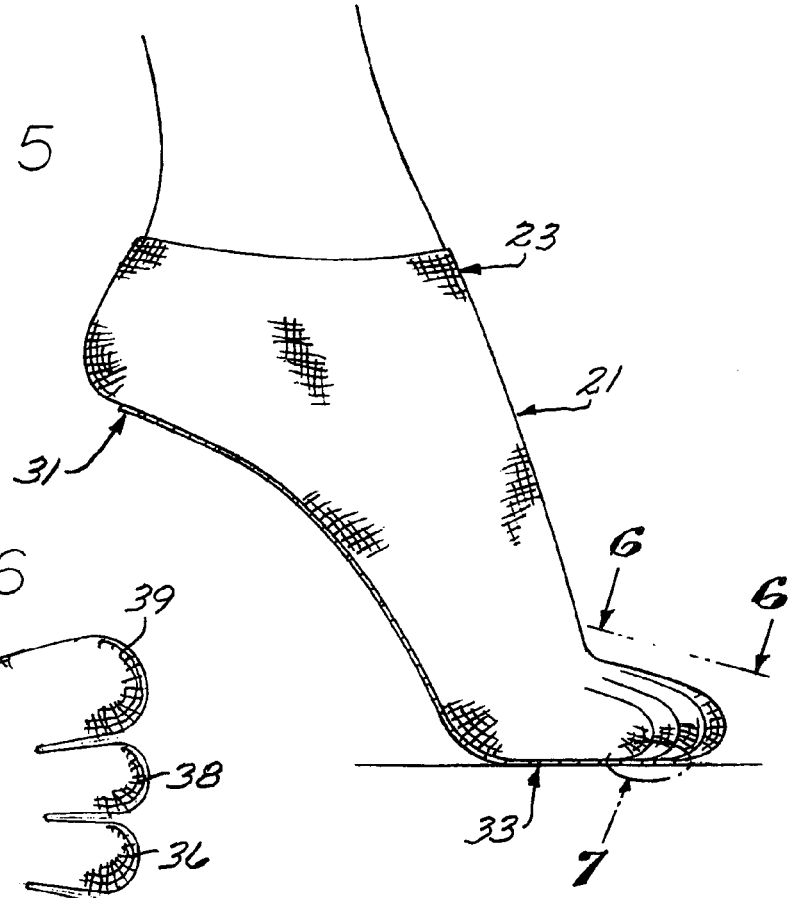
FIG. 5 is a right side view, in reduced scale, of the high friction sock of FIG. 1 on a wearer's foot.
Figure 6:
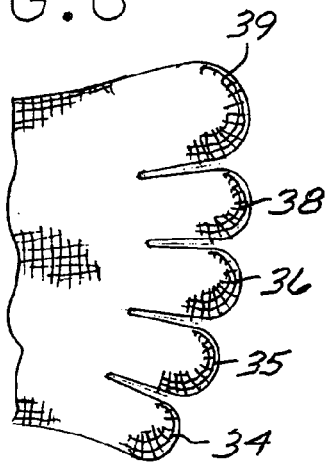
FIG. 6 is a partial top plan view taken along the line 6-6 of FIG. 5.

With this construction I have discovered that the participant can easily slide the gripping sock onto his or her foot and to present a feel not unlike that of a bare foot thus affording maximum flexibility, maneuverability and gripping action. The placement of the wearer's toes within the toe tubes 34, 35, 36, 38 and 39 positions the toes for ready splaying during various floor maneuvers such that the toes can be bent in the metatarsal area as shown in FIG. 5 to spread out as shown in FIG. 6 to thus provide a high degree of maneuverability and flexibility giving the athlete a sense of freedom and security as is so important for pilates. As the exercise is undertaken and forces applied through the foot to the underlying floor, the composite array of buttons in, for instance, the ball and toe area will provide total support for the wearer's weight and will resist slippage as shown in FIG. 7 thereby maintaining a firm grip on the floor surface and resisting unwanted sliding during the floor maneuver.

My invention has proven particularly popular amongst pilates enthusiasts. In this regard, the socks are relatively compact to pack in the wearer's tote kit and, when the exercises are to be commenced, the wearer's street shoes may be removed and the thin woven sock will readily stretch approximately 10% to slide over the wearer's foot and up over the ankle with the toes being received in the toe tubes 34, 35, 36, 38 & 39 as shown in FIGS. 5 and 6. Then, as the wearer manipulates through various maneuvers, whether with the weight primary on the heel, on the ball, foot or up on the toes a firm reliable grip will be maintained with the floor surface. That is, the multiple friction buttons under the ball of the foot and toe as the wearer rises up on the ball of the foot and toes as shown in FIG. 5, the toes are free to splay apart and, on the order of 44 to 45 buttons under the toes and an additional 4 to 5 rows of buttons under the ball of the foot will be in contact with the floor to thus create a substantial cumulative area of frictional contact to provide a stable and reliable support platform under the foot to thereby generate confidence in the mind of the wearer. The buttons, being dimpled upwardly in the center of the bottom surfaces, tend to assume an individual large area foot prints to afford a high degree of frictional contact and acting somewhat as small suction cups.

As the wearer moves about the floor and assumes different positions thus maneuvering the foot about from front to back and side to side, her or she can expect a high number of buttons to maintain favorable contact with the floor surface to thus afford a grip which will minimize slippage irrespective of the particular degree to which the foot is articulated medially, laterally, forward or back.

From the foregoing, it will be apparent that the high grip foot sock of the present invention provides an economical and highly reliable sock which is comfortable to wear, reliable and which will enhance the tactical feel one desires to achieve in high skill active floor exercises.

I claim:

1. A high friction grip sock comprising:

an elastic, stretchable knit material forming tubular ankle and foot portions, the foot portion including a sole portion defining toe, ball and heel sections;

the foot portion formed at its forward extremity with five forwardly projecting seamless, stretchable toe tubes to be stretched and received over the respective toes of a wearer;

an array of high friction buttons spaced uniformly about and adhered to at least the bottom of the toe, ball and heel sections and having respective horizontal cross sections of about an $1/8^{th}$ of an inch; and the knit material is comprised of about 30 gauge thread and the material comprises a blend of a natural fiber and an elastic material.

2. The high friction grip sock of claim 1 wherein:

the buttons are spaced apart by about a $3/8^{th}$ of an inch.

3. The high friction grip sock of claim 1 wherein:

the knit material is constructed with a heddle of about 130 (60×2).

4. The high friction grip sock of claim 1 wherein:

the knit material is constructed to have a stretch of about 10%.

5. The high friction grip sock of claim 1 that includes:

at least 500 high friction buttons.

6. The high friction grip sock of claim 1 wherein:

the high friction buttons have a horizontal dimension of at least an $1/8^{th}$ of an inch.

7. The high friction grip sock of claim 1 wherein:

the high friction buttons have a circular horizontal cross section with a diameter of about an $1/8^{th}$ of an inch.

8. A high friction sock comprising:

an elastic, seamless, knit material comprised of about 30 gauge thread, and a heddle of about 130 with at least 10% stretch and configured to form an ankle and foot portions, the foot portion including bottom wall defining a ball and heal sole sections and the foot portion further including five forwardly disposed seamless toe tubes, the respective bottom walls of the toe tubes defining toe sock section;

an array of high friction buttons having a horizontal cross sectional dimension of about an $1/8^{th}$ inch and a height of about a $1/16^{th}$ and spaced uniformly throughout and adhered to at least the sole section;

the knit material comprises a blend of a natural fiber and an elastic material.

* * * * *